US007032775B1

(12) United States Patent
Almeer et al.

(10) Patent No.: US 7,032,775 B1
(45) Date of Patent: Apr. 25, 2006

(54) TAPE DISPENSER/APPLICATOR DEVICE

(76) Inventors: Mussa A. Almeer, P.O. Box 415, Doha (QA); Amy K. Gieson, P.O. Box 415, Doha (QA)

( * ) Notice: Subject to any disclaimer, the term of this patent is extended or adjusted under 35 U.S.C. 154(b) by 209 days.

(21) Appl. No.: 10/671,210

(22) Filed: Sep. 25, 2003

(51) Int. Cl.
*B65H 1/08* (2006.01)

(52) U.S. Cl. ..... 221/56; 221/58; 221/59; 221/279; 221/303

(58) Field of Classification Search ..... 221/244, 221/49, 46, 303, 59, 56, 58, 95, 197, 198, 221/32, 268, 271, 279, 65, 270, 232; 206/460, 206/441, 447, 813, 820, 556; 100/216
See application file for complete search history.

(56) References Cited

U.S. PATENT DOCUMENTS 2,788,736 A * 4/1957 Bardini ..... 100/232
4,355,720 A 10/1982 Hofberg et al.
4,651,910 A 3/1987 Degroot
4,676,861 A 6/1987 Bishop
4,840,367 A * 6/1989 Geyer et al. ..... 271/160
4,993,586 A 2/1991 Taulbee et al.
D348,898 S 7/1994 Nagasawa
5,678,689 A 10/1997 Clark et al.
D387,799 S 12/1997 Daw et al.
6,514,585 B1 * 2/2003 Pearson et al. ..... 428/40.1
2003/0178437 A1 * 9/2003 Crawford ..... 221/45

* cited by examiner

*Primary Examiner*—Donald P. Walsh
*Assistant Examiner*—Kaitlin Joerger

(57) ABSTRACT

A tape dispenser/applicator device for dispensing and applying tape to packages. The tape dispenser/applicator device includes a housing member having side walls and open top and bottom ends; and also includes a tape cartridge being removably disposed in the housing member and being adapted to store a stack of strips of adhesive tape therein; and further includes a plunger assembly being removably mounted to the housing member and being adapted to dispense the strips of adhesive tape from the tape cartridge and to apply the strips of adhesive tape selectively; and also includes a holder member being removably mounted upon the bottom end of the housing member.

17 Claims, 2 Drawing Sheets

TAPE DISPENSER/APPLICATOR DEVICE

BACKGROUND OF THE INVENTION

1. Field of the Invention

The present invention relates to a tape dispenser and applicator and more particularly pertains to a new tape dispenser/applicator device for dispensing and applying tape to packages.

2. Description of the Prior Art

The use of a tape dispenser and applicator is known in the prior art. More specifically, a tape dispenser and applicator heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,993,586; U.S. Pat. No. 4,355,720; U.S. Pat. No. Des. 348,898; U.S. Pat. No. 4,676,861; U.S. Pat. No. 4,651,910; U.S. Pat. No. 5,678,689; and U.S. Pat. No. Des. 387,799.

While these devices fulfill their respective, particular objectives and requirements, the aforementioned patents do not disclose a new tape dispenser/applicator device. The inventive device includes a housing member having side walls and open top and bottom ends; and also includes a tape cartridge being removably disposed in the housing member and being adapted to store a stack of strips of adhesive tape therein; and further includes a plunger assembly being removably mounted to the housing member and being adapted to dispense the strips of adhesive tape from the tape cartridge and to apply the strips of adhesive tape selectively; and also includes a holder member being removably mounted upon the bottom end of the housing member.

In these respects, the tape dispenser/applicator device according to the present invention substantially departs from the conventional concepts and designs of the prior art, and in so doing provides an apparatus primarily developed for the purpose of dispensing and applying tape to packages.

SUMMARY OF THE INVENTION

In view of the foregoing disadvantages inherent in the known types of tape dispenser and applicator now present in the prior art, the present invention provides a new tape dispenser/applicator device construction wherein the same can be utilized for dispensing and applying tape to packages.

The general purpose of the present invention, which will be described subsequently in greater detail, is to provide a new tape dispenser/applicator device which has many of the advantages of the tape dispenser and applicator mentioned heretofore and many novel features that result in a new tape dispenser/applicator device which is not anticipated, rendered obvious, suggested, or even implied by any of the prior art tape dispenser and applicator, either alone or in any combination thereof.

To attain this, the present invention generally comprises a housing member having side walls and open top and bottom ends; and also includes a tape cartridge being removably disposed in the housing member and being adapted to store a stack of strips of adhesive tape therein; and further includes a plunger assembly being removably mounted to the housing member and being adapted to dispense the strips of adhesive tape from the tape cartridge and to apply the strips of adhesive tape selectively; and also includes a holder member being removably mounted upon the bottom end of the housing member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tape dispenser/applicator device which has many of the advantages of the tape dispenser and applicator mentioned heretofore and many novel features that result in a new tape dispenser/applicator device which is not anticipated, rendered obvious, suggested, or even implied by any of the prior art tape dispenser and applicator, either alone or in any combination thereof.

It is another object of the present invention to provide a new tape dispenser/applicator device which may be easily and efficiently manufactured and marketed.

It is a further object of the present invention to provide a new tape dispenser/applicator device which is of a durable and reliable construction.

An even further object of the present invention is to provide a new tape dispenser/applicator device which is susceptible of a low cost of manufacture with regard to both materials and labor, and which accordingly is then susceptible of low prices of sale to the consuming public, thereby making such tape dispenser/applicator device economically available to the buying public.

Still yet another object of the present invention is to provide a new tape dispenser/applicator device which provides in the apparatuses and methods of the prior art some of the advantages thereof, while simultaneously overcoming some of the disadvantages normally associated therewith.

Still another object of the present invention is to provide a new tape dispenser/applicator device for dispensing and applying tape to packages.

Yet another object of the present invention is to provide a new tape dispenser/applicator device which includes a housing member having side walls and open top and bottom ends; and also includes a tape cartridge being removably disposed in the housing member and being adapted to store a stack of strips of adhesive tape therein; and further includes a plunger assembly being removably mounted to the housing member and being adapted to dispense the strips of adhesive tape from the tape cartridge and to apply the strips of adhesive tape selectively; and also includes a holder member being removably mounted upon the bottom end of the housing member.

Still yet another object of the present invention is to provide a new tape dispenser/applicator device that is easy and convenient to use.

Even still another object of the present invention is to provide a new tape dispenser/applicator device that saves the user time when taping wrapping paper about packages.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
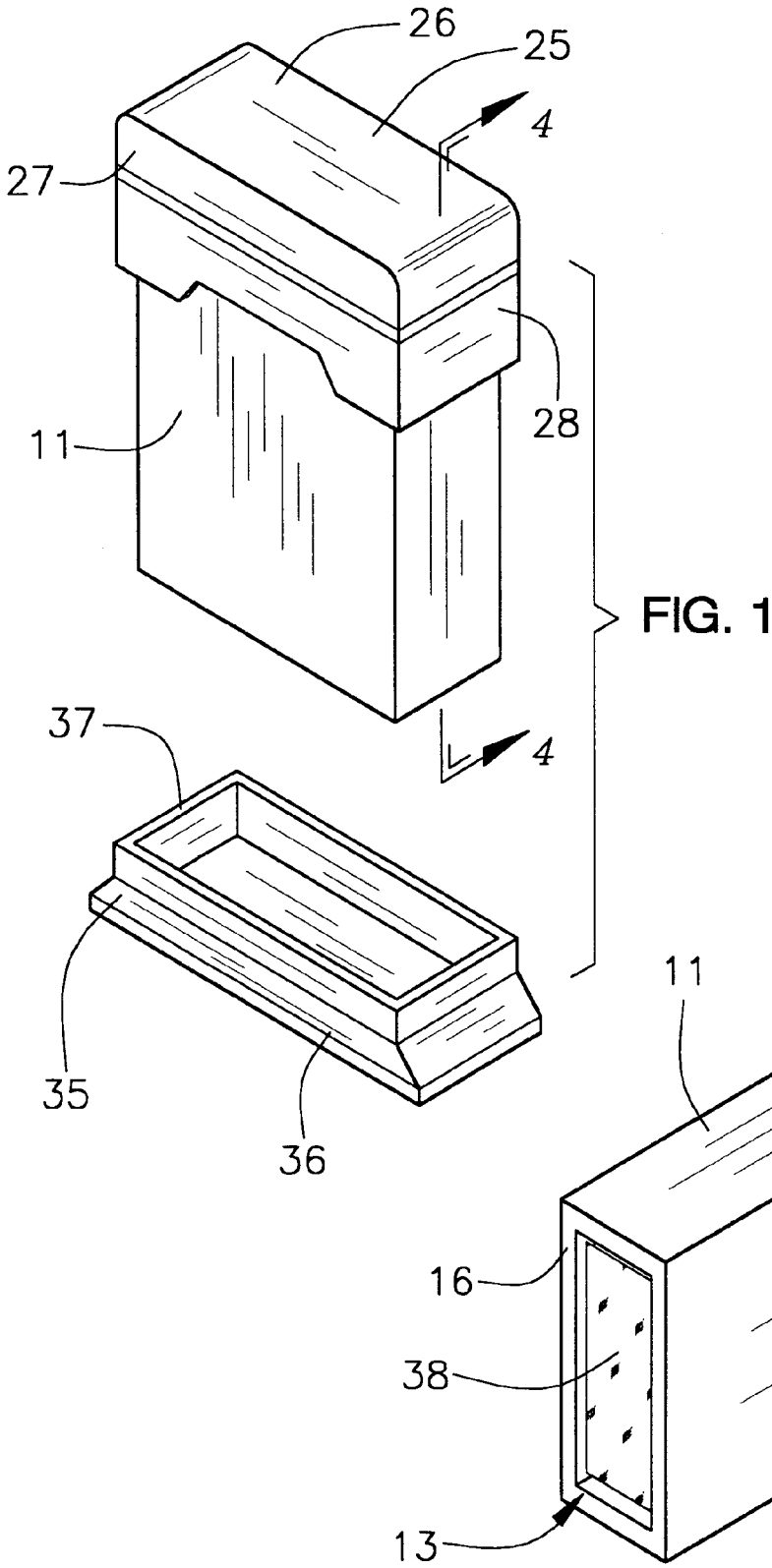
FIG. 1 is a top perspective view of a new tape dispenser/applicator device according to the present invention.
Figure 2:
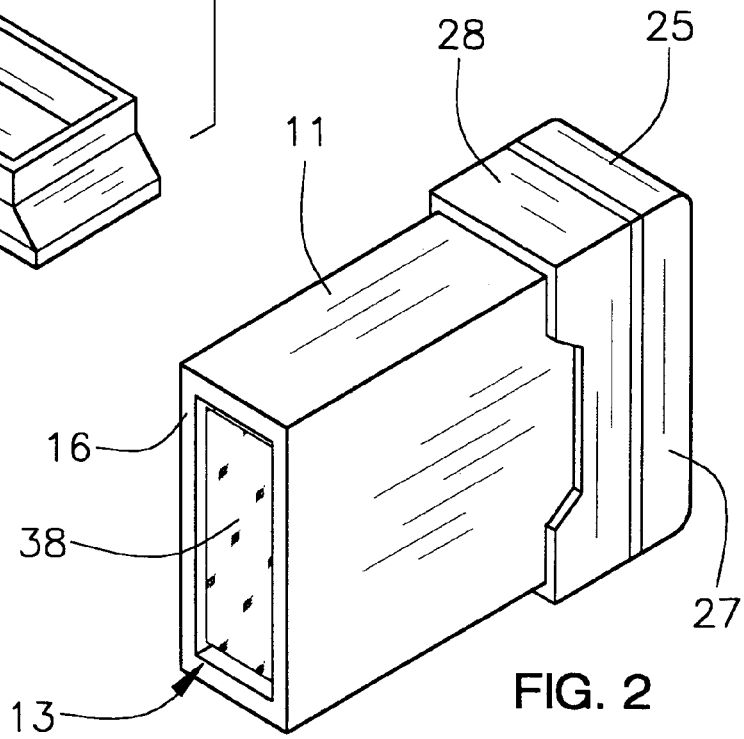
FIG. 2 is a bottom perspective view of the dispensing and applicating assembly of present invention.
Figure 3:
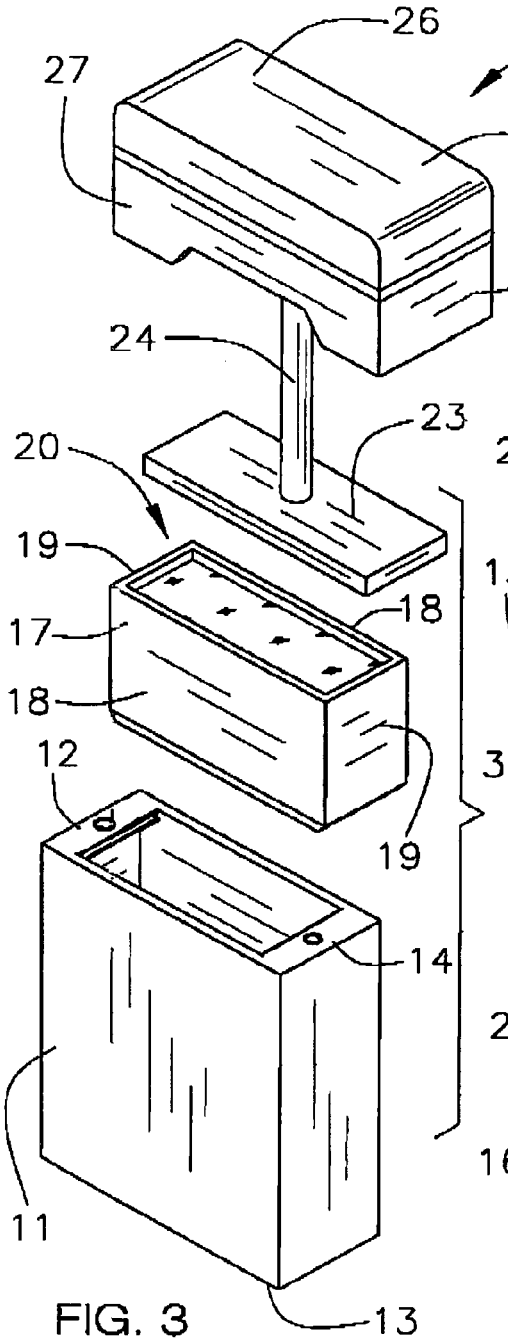
FIG. 3 is an exploded perspective view of the dispensing and applicating assembly of the present invention.
Figure 4:
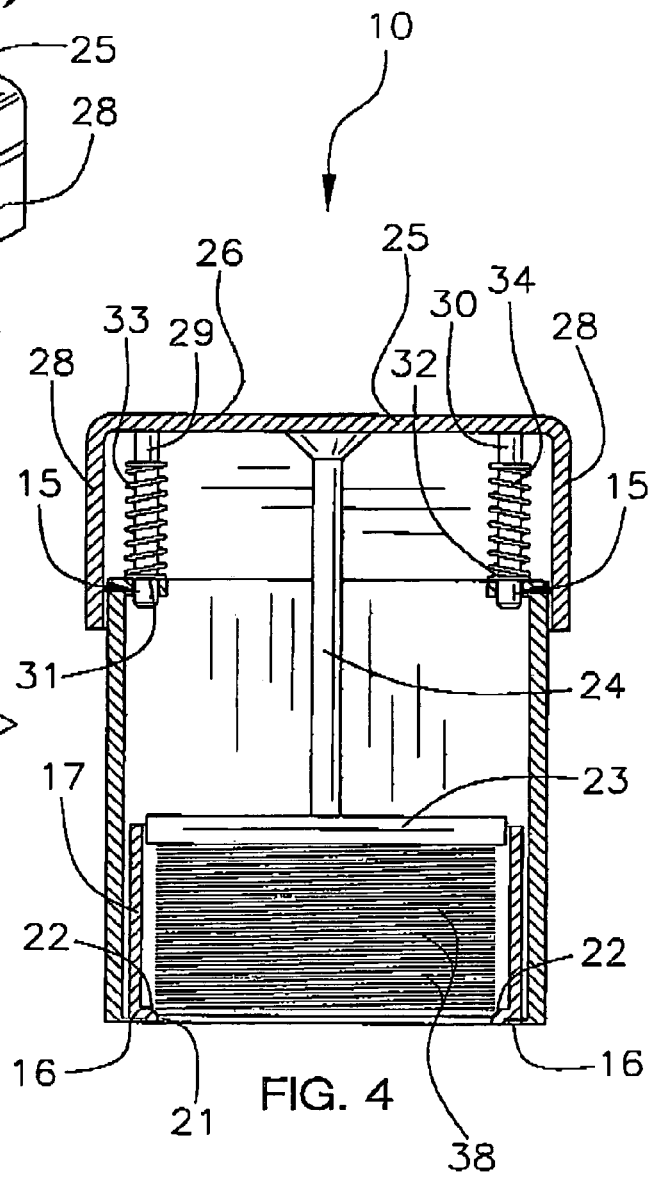
FIG. 4 is a cross-sectional view of the present invention.

With reference now to the drawings, and in particular to FIGS. 1 through 4 thereof, a new tape dispenser/applicator device embodying the principles and concepts of the present invention and generally designated by the reference numeral 10 will be described.

As best illustrated in FIGS. 1 through 4, the tape dispenser/applicator device 10 generally comprises a housing member 11 having side walls and open top and bottom ends 12,13. The housing member 11 also has top and bottom rims 14,16 being disposed at the open top end 12 and the open bottom end 13. The top and bottom rims 14,16 are disposed inwardly of the open top and bottom ends 12,13. The top rim 14 further has holes 15 being disposed therethrough. The housing member 11 has a length of approximately 5 to 6 inches, a width of approximately 3 inches, and a depth of approximately 2 inches.

A tape cartridge 17 is removably disposed in the housing member 11 and is adapted to store a stack of strips of adhesive tape 38 therein. The tape cartridge 17 includes a container having side and end walls 18,19 and also having open top and bottom ends 20,21 and further having a beveled stop member 22 being conventionally disposed at the bottom end 21. The beveled stop member 22 is removably disposed upon the bottom rim 16 of the housing member 11 and is adapted to allow the strips of adhesive tape 38 to be dispensed one at a time through the open bottom end 21 of the tape cartridge 17.

A plunger assembly is removably mounted to the housing member 11 and is adapted to dispense the strips of adhesive tape 38 from the tape cartridge 17 and to apply the strips of adhesive tape 38 selectively. The plunger assembly includes a plunger member 23 being engagable with the strips of adhesive tape 38 in the tape cartridge 17, and also includes an elongate plunger support member 24 having a bottom end securely and conventionally attached to the plunger member 24, and further includes a drive member 25 being conventionally attached to a top end of the elongate plunger support member 24, and also includes elongate drive support members 29,30 being securely and conventionally attached to the drive member 25, and further includes spring support members 31,32 being conventionally mounted about the elongate drive support members 29,30, and also includes spring members 33,34 being mounted about the elongate drive support members 29,30 for biasing the drive member 25 outwardly relative to the housing member 11. The plunger member 23 is pressable upon the stack of the strips of adhesive tape 38 in the tape cartridge 17. The drive member 25 has a top wall 26, and also has side and end walls 27,28 which are movably disposed about the housing member 11. The elongate drive support members 29,30 are movably disposed through the holes 15 in the top rim 14 of the housing member 11 and are securely and conventionally attached to an underside of the top wall 26. The spring support members 31,32 are washer-like members which are disposed about the elongate drive support members 29,30 and which are disposed upon the top rim 14 of the housing member 11. The spring members 33,34 are disposed between the top wall 26 of the drive member 25 and the spring support members 31,32.

A holder member 35 is removably mounted upon the bottom end 13 of the housing member 11. The holder member 35 includes a planar base portion 36 being adapted to rest upon a surface, and also includes an upper portion having a wall structure 37 being conventionally disposed along and attached to a perimeter of the planar base portion 36 and being adapted to receive the bottom end 13 of the housing member 11 therebetween.

In use, the user loads the tape cartridge with a stack of strips of adhesive tape 38, and places the plunger member 23 upon the top of the stack, and places the bottom end 13 of the housing member 11 upon the location to where the user wants to adhere a strip of adhesive tape, and presses upon the drive member 25 which urges the plunger member 23 upon the stack of strips of adhesive tape 38 with the bottom-most strips of adhesive tape being urged out of the tape cartridge 17 and upon the desired location.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A tape dispenser/applicator device comprising:

a housing member having side walls and open top and bottom ends;

a tape cartridge being removably disposed in said housing member and being adapted to store a stack of strips of adhesive tape therein;

a plunger assembly being removably mounted to said housing member and being adapted to dispense the strips of adhesive tape from said tape cartridge and to apply the strips of adhesive tape selectively; and a holder member being removably mounted upon said bottom end of said housing member;

wherein said housing member also has top and bottom rims being disposed at said open top end and said open bottom end, said top and bottom rims being disposed inwardly of said open top and bottom ends, said top rim further having holes disposed therethrough;

wherein said tape cartridge is a container having side and end walls and also having open top and bottom ends and further having a beveled stop member being disposed at said bottom end, said beveled stop member being removably disposed upon said bottom rim of said housing member and being adapted to allow the strips of adhesive tape to be dispensed one at a time through said open bottom end of said tape cartridge; and wherein said plunger assembly includes a plunger member being engagable with the strips of adhesive tape in said tape cartridge; and also includes an elongate plunger support member halving a bottom end securely attached to said plunger member; and further includes a drive member being attached to a top end of said elongate plunger support member; and also includes elongate drive support members being securely attached to said drive member; and further includes spring support members being mounted about said elongate drive support members; and also includes spring members being mounted about said elongate drive support members for biasing said drive member outwardly relative to said housing member.

2. A tape dispenser/applicator device as described in claim 1, wherein said plunger member is pressable upon said stack of said strips of adhesive tape in said tape cartridge.

3. A tape dispenser/applicator device as described in claim 1, wherein said drive member has a top wall, and also has side and end walls which are movably disposed about said housing member.

4. A tape dispenser/applicator device as describe in claim 1, wherein said elongate drive support members are movably disposed through said holes in said top rim of said housing member and are securely attached to an underside of said top wall.

5. A tape dispenser/applicator device as described in claim 2, wherein said spring support members are washer-like members which are disposed about said elongate drive members and which are disposed upon said top rim of said housing member, said spring members being disposed between said top wall of said drive member and said spring support members.

6. A tape dispenser/applicator device as described in claim 1, wherein said holder member includes a planar base portion being adapted to rest upon a surface, and also includes an upper portion having a wall structure being disposed along and attached to a perimeter of said planar base portion and being adapted to receive said bottom end of said housing member therebetween.

7. A tape dispenser/application device comprising:

housing member having side walls and open top and bottom ends, said housing member also having top and bottom rims being disposed at said open top end and said open bottom end, said top and bottom rims being disposed inwardly of said open top and bottom ends, said top rim further having hales disposed therethrough, said housing member having a length of approximately 5 to 6 inches, a width of approximately 3 inches, and a depth of approximately 2 inches;

a tape cartridge being removably disposed in said housing member and being adopted to store a stack of strips of adhesive tape therein, said tape cartridge including a container having side and end walls and also having open top and bottom ends and further having a beveled stop member being disposed at said bottom end, said beveled stop member being removably disposed upon said bottom rim of said housing member and being adapted to allow the strips of adhesive tape to be dispensed one at a time through said open bottom end of said tape cartridge;

a plunger assembly being removably mounted to said housing member and being adapted to dispense the strips of adhesive tape from said tape cartridge and to apply the strips of adhesive tape selectively, said plunger assembly including a plunger member being engagable with the strips of adhesive tape in said tape cartridge, and also including an elongate plunger support member having a bottom end securely attached to said plunger member, and further including a drive member being attached to a top end of said elongate plunger support member, and also including elongate drive support members being securely attached to said drive member, and further including spring support members being mounted about said elongate drive support members, and also including spring members being mounted about said elongate drive support members for biasing said drive member outwardly relative to said housing member, said plunger member being pressable upon said stack of said strips of adhesive tape in said tape cartridge, said drive member having a top wall, and also having side and end walls which are movably disposed about said housing member, said elongate drive support members being movably disposed through said holes in said top rim of said housing member and being securely attached to an underside of said top wall, said spring support members being washer-like members which are disposed about said elongate drive members and which are disposed upon said top rim of said housing member, said spring members being disposed between said top wall of said drive member and said spring support members; and a holder member being removably mounted upon said bottom end of said housing member, said holder member including a planar base portion being adapted to rest upon a surface, and also including an upper portion having a wall structure being disposed along and attached to a perimeter of said planar base portion and being adapted to receive said bottom end of said housing member therebetween.

8. A tape dispenser/applicator device comprising:

a housing member having side walls and open top and bottom ends;

a tape cartridge being removably disposed in said housing member, a stack of strips of adhesive tape being positioned therein;

a plunger assembly being removably mounted to said housing member and being adapted to dispense the strips of adhesive tape from said tape cartridge and to apply the strips of adhesive tape selectively; and a holder member being removably mounted upon said bottom end of said housing member;

wherein said tape cartridge forms a container having side and end walls and also having open top and bottom ends, said container having a beveled stop member being disposed at said bottom end to make said open bottom end smaller than a perimeter of each strip of said strips of adhesive tape such that movement of said strips through said open bottom end requires said plunger assembly to push on said stack of strips of adhesive tape.

9. A tape dispenser/applicator device as described in claim 8, wherein said beveled stop member is removably disposed upon a bottom rim of said housing member.

10. A tape dispenser/applicator device as described in claim 8, wherein said plunger assembly includes:

a plunger member being engagable with the strips of adhesive tape in said tape cartridge;

an elongate plunger support member having a bottom end mounted on said plunger member; and a drive member being attached to a top end of said elongate plunger support member.

11. A tape dispenser/applicator device as described in claim 10, wherein said plunger assembly further includes:

elongate drive support members being securely attached to said drive member;

spring support members being mounted about said elongate drive support members; and spring members being mounted about said elongate drive support members for biasing said drive member outwardly relative to said housing member.

12. A tape dispenser/applicator device as described in claim 8, wherein said housing member also has top and bottom rims being disposed at said open top end and said open bottom end, said top and bottom rims being disposed inwardly of said open top and bottom ends, said top rim further having holes disposed therethrough.

13. A tape dispenser/applicator device as described in claim 10, wherein said plunger member is pressable upon said stack of said strips of adhesive tape in said tape cartridge.

14. A tape dispenser/applicator device as described in claim 10, wherein said drive member has a top wall, and also has side and end walls which are movably disposed about said housing member.

15. A tape dispenser/applicator device as described in claim 11, wherein said elongate drive support members are movably disposed through said holes in said top rim of said housing member and are attached to an underside of said top wall.

16. A tape dispenser/applicator de as described in claim 11, wherein said spring support members are washer-like members which are disposed about said elongate drive members and which are disposed upon said top rim of said housing member, said spring members being disposed between said top wall of said drive member and said spring support members.

17. A tape dispenser/applicator device as described in claim 8, wherein said holder member includes a planar base portion being adapted to rest upon a surface, and also includes an upper portion having a wall structure being disposed along and attached to a perimeter of said planar base portion and being adapted to receive said bottom end of said housing member therebetween.

* * * * *